US005636011A

United States Patent [19]

Fujiwara et al.

[11] Patent Number: 5,636,011

[45] Date of Patent: Jun. 3, 1997

[54] STATIC ELECTRICITY REMOVAL METHOD AND APPARATUS FOR IMAGE CARRIER

[75] Inventors: Shouzou Fujiwara; Akihiko Uematsu; Toshio Hino; Shinji Ohshima, all of Kawasaki, Japan

[73] Assignee: Fujitsu Limited, Takahashi, Japan

[21] Appl. No.: 124,488

[22] Filed: Sep. 22, 1993

[30] Foreign Application Priority Data

Mar. 3, 1993 [JP] Japan ..... 5-042560

[51] Int. Cl.[6] ..... G03G 15/16

[52] U.S. Cl. ..... 399/315

[58] Field of Search ..... 355/219, 274, 355/221; 361/212, 213

[56] References Cited

U.S. PATENT DOCUMENTS

| | | | |
|---|---|---|---|
| 983,536 | 2/1911 | Chapman | 219/216 X |
| 3,830,589 | 8/1974 | Allen | 355/274 |
| 3,832,053 | 8/1974 | Goel et al. | 355/274 |
| 4,077,709 | 3/1978 | Borostyan et al. | 355/274 |
| 4,130,852 | 12/1978 | Peffer et al. | 361/213 |
| 4,553,191 | 11/1985 | Franks, Jr. et al. | 361/212 |
| 4,821,071 | 4/1989 | Oka et al. | 355/219 X |
| 4,979,000 | 12/1990 | Hamada et al. . | |
| 5,049,934 | 9/1991 | Saito | 355/219 |
| 5,172,173 | 12/1992 | Goto et al. | 355/274 X |
| 5,225,879 | 7/1993 | Hayashida | 355/274 |

FOREIGN PATENT DOCUMENTS

| | | |
|---|---|---|
| 0 342 600 | 11/1989 | European Pat. Off. . |
| 3931234 A1 | 3/1990 | Germany . |
| 84PAT1200 | 12/1994 | Germany . |
| A-56-125768 | 10/1981 | Japan . |
| A-58-30775 | 2/1983 | Japan . |
| A-60-111276 | 6/1985 | Japan . |
| A-3-45794 | 2/1991 | Japan . |

*Primary Examiner*—William J. Royer

*Attorney, Agent, or Firm*—Armstrong, Westerman, Hattori, McLeland & Naughton

[57] ABSTRACT

A static electric charge removal method and apparatus of an image carrier, in which more than two ion generating units are arranged in parallel to each other perpendicular to the static electric charge removal advancing direction of the image carrier. The bias electric field strength between a first ion generating device positioned downstream of the electric charge removal advancing direction and the photosensitive body has a greater value than the bias electric field strength between a second ion generating device positioned upstream of the photosensitive body.

6 Claims, 6 Drawing Sheets

Fig. 5(a)

COMPARISON RESULTS AGAINST TWO COMPARISON EXAMPLES

| | DISTANCE BETWEEN PHOTOSENSITIVE DRUM AND WIRES (mm) | | | BIAS VOLTAGE (v) | PRINTING RESULT | |
|---|---|---|---|---|---|---|
| | 32A | 32B | 32C | | SEPARA TION | QUALITY |
| THIS EMBODIMENT | 10 | 10 | 8 | 1000 | 0 | 0 |
| COMPARISON EXAMPLE A | 10 | 10 | 10 | 1200 | 0 | X |
| COMPARISON EXAMPLE B | 10 | 10 | 10 | 1000 | X | 0 |

STATIC ELECTRICITY REMOVAL METHOD AND APPARATUS FOR IMAGE CARRIER

BACKGROUND OF THE INVENTION

1. Field of the Invention

The present invention relates to a static electricity removal method and a static electricity removal apparatus for a copied image carrier (such as, print paper), which supplies reverse polarity ions to the back of the image carrier to eliminate the charged state of said image carrier, after the charged image carrier has accepted a transferred image.

2. Description of the Related Art

In a copier or a printer utilizing the principles of electrophotography, (1) light illuminates an evenly charged photosensitive body to form a latent image as a charged pattern, (2) a toner powder is sprinkled on the latent image to form a transferable image according to the charged pattern, and (3) an image carrier, such as print paper, is placed on the surface of photosensitive body to collect the toner image, in the process of placing the image carrier, such as the paper, on to the surface of photosensitive body to collect the toner image, (4) the image carrier is charged to a reverse polarity, compared to the toner image, for securing the attractive force between the image carrier and the toner image, (5) and after the image has been transferred, the reverse polarity ions on the image carrier are removed from the back face of the image carrier for simplifying the separation of image carrier from the photosensitive body.

For example, in a laser printer using a cylindrical photosensitive body, the processing units of the above mentioned items (1) through (5) are arranged in sequence on the circumference of the rotatable photosensitive body, and in one rotation of the photosensitive body turning at a high speed, the processing of aforesaid Items (1) through (5) are sequentially executed on the line crossing the cylindrical face (See FIG. 2).

That is to say, (1) a continuous laser beam scans the cylindrical face of the photosensitive body which is charged to +400 V to drop the charge at the illuminated point and to form a latent image by an electric charge pattern, (2) a black toner is sprinkled on the latent image to selectively hold it with electrostatic electricity on the latent image and to develop the charge pattern, (3) the developed black toner image is transferred to the surface of the image carrier (paper), (4) the paper, prior to its getting in touch with the photoelectric body, is irradiated with negative ions from its back side and is charged to −200 V, and (5) then, with the paper coming in contact with the photosensitive body, positive ions are irradiated from its back side to offset the electric charge on the paper.

Here, any ion generating unit which can be used in the applications of Items (4) and (5) comprises wire electrodes arranged opposite to the cylindrical face of photosensitive body. The wire electrodes are applied with a high voltage to perform a discharge for forming positive and negative ions in the air. The polarity of voltage being applied to the wire electrodes decides which of these positive and negative ions are utilized. In the application of Item (4), for example, a relatively high direct current voltage, such as −7 kV, is applied to a single wire electrode, whereas in the application of Item (5) an alternating current voltage of 12 kV, peak-to-peak, having a bias voltage of 1000 V (direct current) is applied to two wire electrodes arranged in parallel.

A high processing speed is required from a copier and a printer utilizing the principle of electrophotography.

However, (5) the electricity removal unit for emitting a reverse polarity ion against the charged state of image carrier from the back face of image carrier becomes an obstruction to the realization of high speed.

In other words, if high speed processing is used the speed of the image carrier is increased and this shortens the time available to remove the change from the image carrier. Therefore, if the ion irradiation intensity is increased to complete the electricity removal within a short time, a part of toner adsorbed on the image carrier will be repelled by the image carrier and return to the photosensitive body, and the quality of a printed image or printed letters will be reduced.

However, unless the ion irradiation intensity is increased, the electrostatic charge cannot be completely removed from the image carrier, the photosensitive body cannot be easily separated from the image carrier, and the static electricity on the image carrier makes the handling of the image carrier difficult at each of the later processes.

For instance, in the foregoing laser printer, using a cylindrical photosensitive body as a photosensitive body, (4) the black toner image electrostatically holds on to the charge pattern (latent image) by a charge of +50 V on the cylindrical face of photosensitive body is overlapped with the paper charged to −200 V for electrostatically adsorbing the black toner image on the paper side. If the bias voltage to be impressed to the wire electrode should be increased up to 1500 V to increase the ion irradiation intensity (output current) and to rapidly offset the charged state of paper, the attractive force on the cylindrical face of photosensitive body against the black toner image becomes more influential than the attractive force of the paper. Therefore, when the paper has been separated from the photosensitive body, the black toner image may be held by the photosensitive body.

However, if the bias voltage to be impressed to the wire electrode should remain at 1000 V in order to leave the black toner image on the paper, the electric charge removal becomes insufficient when the photosensitive body turns at a high speed, and the paper cannot be easily separated from the photosensitive body. Therefore, a mechanical means for separation (a scraping blade, etc.) may be required. The paper jamming is likely to be caused also in the paper feeding mechanism at the later stage.

SUMMARY OF THE INVENTION

An object of the present invention is to present a static electricity removal method and a static electricity removal unit for an image carrier which does not prevent high-speed processing in a copier and a printer utilizing the principle of electrophotography.

This invention covers an object for providing a static electricity removal method and a static electricity removal unit for an image carrier, in which the quality of printed matter can be secured because the toner adsorbed on the image carrier does not return to the photosensitive body and the image carrier can be easily separated from the photosensitive body because the electricity removal of image carrier has been sufficiently secured.

According to one aspect of the present invention, there is provided a static electricity removal method comprising the steps of: forming an image on a photosensitive body; electrostatically attaching an electrically charged image carrier to said photosensitive body; supplying ions of reverse polarity to the electric charge on said image carrier to a back surface thereof to offset the charged state of said image carrier so as to easily separate said image carrier from said photosensitive body; and emitting ions from at least two ion generating means arranged to emit ions onto the image carrier, so that the strength of the bias electric field between the first ion generating means positioned downstream and said photosensitive body is larger than that of bias electric field between the second ion generating means positioned upstream and said photosensitive body.

According to another aspect of the present invention there is provided a static electricity removal apparatus comprising: at least two ion generating means arranged near the photosensitive surface of a photosensitive body for emitting ions onto said photosensitive surface; and a distance between the first ion generating means positioned downstream and said photosensitive surface being shorter than a distance between the second ion generating means positioned upstream and said photosensitive surface.

According to a still another aspect of the present invention, there is provided a static electricity removal apparatus comprising: at least two ion generating means arranged near a photosensitive surface of a photosensitive body for emitting ions onto said photosensitive surface; and a bias voltage exerted to the first ion generating means positioned downstream being higher than that exerted to the second ion generating means positioned upstream.

According to further aspect of the present invention, there is provided a static electricity removal apparatus comprising: at least two wires arranged in a direction across a photosensitive surface of a photosensitive body and in parallel to each other for emitting ions onto said photosensitive surface; frame means for supporting and insulating said wires, so that the positions of said wires with respect to said photosensitive surface are fixed; means for supplying high voltage alternating current biased by direct current voltage to said wires, respectively; and the strength of bias electric field formed between the first wire positioned downstream and said photosensitive body being larger than that of bias electric field formed between the second wire positioned upstream and said photosensitive body.

In one embodiment of this invention a static electricity removal apparatus further comprises: another wire in addition to said at least two wires, a high voltage negative direct current being applied to said another wire; a image carrier; and said frame means further supporting said another wire integrally with said at least two wires, so that said another wire is located at a position still upstream than said at least two wires and the position of said another wire is fixed.

In another embodiment, the first wire positioned at the downstream is located nearer to said photosensitive surface than the second wire positioned upstream; and the apparatus further comprises: high-voltage power supply means for supplying alternating current having a common amplitude to said at least two wires; and bias voltage regulating means for regulating the alternating current supplied by said high-voltage power supplying means in accordance with a kind of image carrier, or the surface speed of said photosensitive body.

DETAILED DESCRIPTION OF THE PREFERRED EMBODIMENTS

Figure 1:
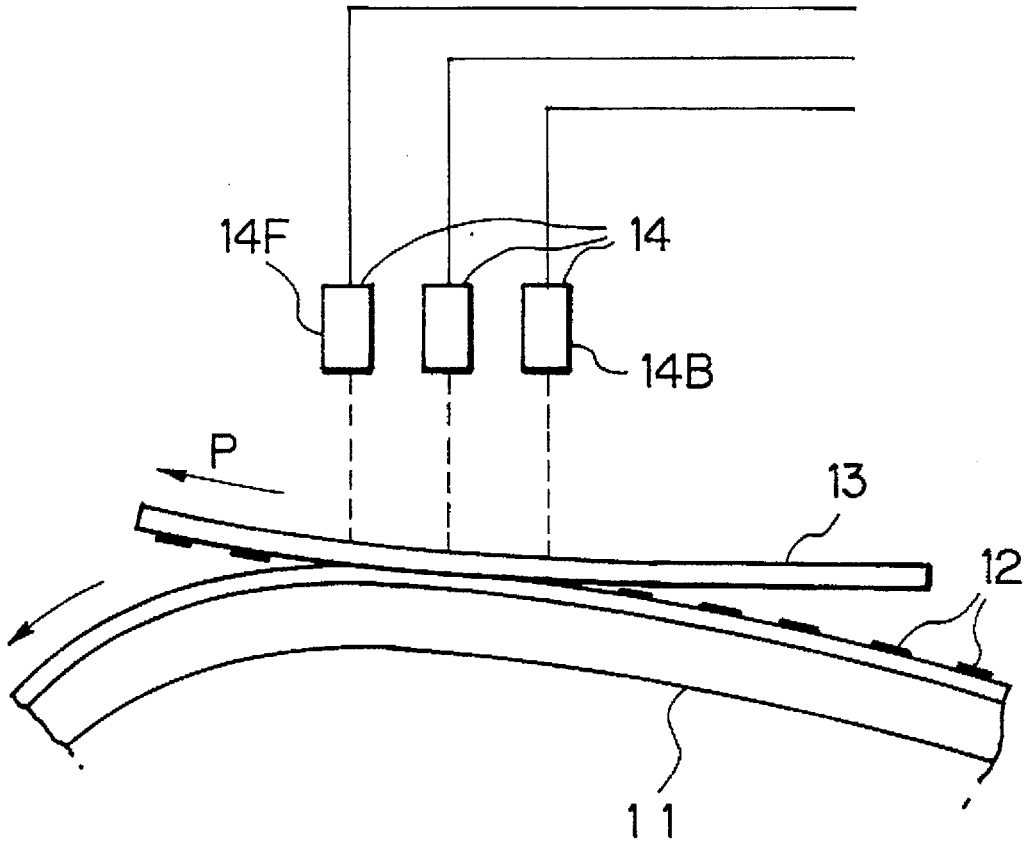
FIG. 1 is an explanatory drawing of the basic structure of the static electric charge removal method of the image carrier.

Referring now to the drawings, in the static electricity removal method shown in FIG. 1, the strength of the bias electric field for accelerating the generated ions toward the image carrier (print paper) is increased or decreased for setting a difference in electricity removal capability between an ion generating means 14F positioned at the downstream (a subsequent position in the advance direction of the image carrier) and an ion generating means 14B positioned upstream (a preceding position).

The image carrier 13, charged to a reverse polarity against the surface of photosensitive body 11 (holding a transferred image 12) comes into contact with the photosensitive body 11. The transferred image 12 on the photosensitive body 11 has initially been electrostatically held on the surface of the photosensitive body 11, but is attracted to the stronger electric charge of the image carrier 13 and becomes attached to the transferred body 13.

Then, if the ion generating means 14 emits ions to the back side of the image carrier 13 to offset the electric charge on the image carrier 13 and moreover has given to the image carrier 13 a reverse polarity electric charge (the same polarity as on the photosensitive body 11) at a level for the image carrier 13 to be able to maintain the transferred image 12, the mutual attractive forces between the photosensitive body 11 and image carrier 13 disappear and the image carrier 13 can then be easily separated from the photosensitive body 11 with the transferred image 12 being carried thereon.

If the static electricity on the image carrier 13 is removed too suddenly by the ion generating means 14B through which said body first passed, the transferred image 12 which was carried over to the image carrier 13 returns back to the photosensitive body 11, and the transferred image 12 is not left on the image carrier 13 separated from the photosensitive body 11. Therefore, the bias electric field strength for energizing the ion generating means 14B toward image carrier 11 should be lowered to slowly execute static electricity removal from the image carrier 13.

As a method for lowering the bias electric field strength, a method for (1) lowering the bias voltage to be given to the ion generating means 14B, or (2) moving the ion generating means 14B away from the photosensitive body 11 can be adopted.

Here, the photosensitive body 11 is made by covering the surface of a conductive support material with a substance which changes its conductivity in the presence of light. For example, a photosensitive body in which the support material is made of a metal cylinder, or a photosensitive belt in which the support material is made of a metallic sheet supported in a belt system, can be adopted. Furthermore, the photosensitive body 11 may be one in which a latent image is formed by any method other than light. A latent image carrying body, in a wide sense, for forming an electrostatic latent image through electric, magnetic, or mechanical actions may also be used.

In addition, the image carrier 13 is a record medium for copying a transferred image on the photosensitive body 1 formed by the toner (for example, a black toner powder) to fix the image on the surface. A continuous material, or a sheet (for example, a cut paper) made of such materials as the paper, cloth, resin, leather, etc., can be used.

Additionally, as an ion generating means 14, a corona discharge generating unit using a wire, a knife edge or a rod, an electronic releasing unit using a photoelectric material and a light source, or a plasma generating unit utilizing a high frequency electric discharge, can be adopted. At any rate, a bias voltage set to the reverse polarity (positive or negative) against the electric charge of image carrier 13 is impressed to the ion generating means 14. The bias voltage forms a bias electric field between the ion generating unit 14 and the photosensitive body 11, and energizes the image carrier 13 with generated ions of reverse polarity compared with the electric charge of image carrier 13.

In the above-mentioned static electricity removal unit, the ion generating means positioned upstream is kept away from the photosensitive body and its electricity removal capability is low compared to that of the ion generating means positioned on the front side.

In the illustrated electricity removal unit, the ion generating means positioned at the upstream is supplied with a lower bias voltage and its electricity removal capability has been reduced compared to that of the ion generating means positioned on the front side.

In the electricity removal unit of this invention, the ion generating means may be limited to a corona electric discharge generator of wire type. The wire is supplied with a high voltage to generate a corona electric discharge for generating ions in the air. The generated ions are accelerated along the electric field around the wire and reach the image carrier, thus offsetting the electric charge of image carrier.

More than two wires may be supported together by a frame body for the provision of their independent bias voltages, or the distance between the wire and the photosensitive body may also be increased or decreased when supplying a common bias voltage. In any of the cases, a weaker bias electric field is provided to the wire positioned at the upstream in comparison with that of the wire positioned on the downstream and its electricity removal capability is reduced.

In the electricity removal unit of this invention, an electric charger for charging the transferred body negatively, before it contacts the photosensitive body, may be structured integrally with the electricity removal unit. The electric charger is composed of a corona discharge generator of a wire type similar to the electricity removal unit, and differs only in its mounted position, compared to the photosensitive body, and its impressed voltage.

In the electricity removal unit of this invention, a high-voltage alternating current common to more than two wires may be applied by a high-voltage power source. The high-voltage alternating current which is applied to the wire generates a corona electric discharge around the wire to form ions. Also, the reverse polarity bias voltage applied to the image carrier forms a bias electric field in the space around the photosensitive body (or an electrically charged paper and the like), accelerates the ion (the polarity of which is against the electric charge of image carrier) toward the image carrier side and forms a leak current in the wire. The bias voltages in the more than two wires may be the same or then may be different.

If the surface speed of the photosensitive body is too high, the absolute volume of the reverse polarity ions being received by the image carrier is reduced throughout the time the image carrier passes through the electricity removal unit, and there is a possibility that the static electricity removal is incomplete. Therefore, the bias voltage regulating means regulates the balance of the respective bias voltages in more than two wires and increases the absolute volume of the reverse polarity ions which should be received by the image carrier when it passes through the electricity removal unit.

Further, a thin or weak image carrier needs a greater number of reverse polarity ions to increase the separation by electrostatic force because separation from the photosensitive body by the image carriers own elasticity cannot be expected. Therefore, the bias voltage regulating means increases the bias voltage to wire to increase the absolute volume of reverse polarity ions being received by the image carrier throughout the time it passes through the electricity removal unit.

The bias voltage can be regulated by any of, (1) an operator to set an adequate bias voltage or, (2) a sensor is installed to detect the print conditions to make a printer automatically perform a similar adjustment.

Figure 2:
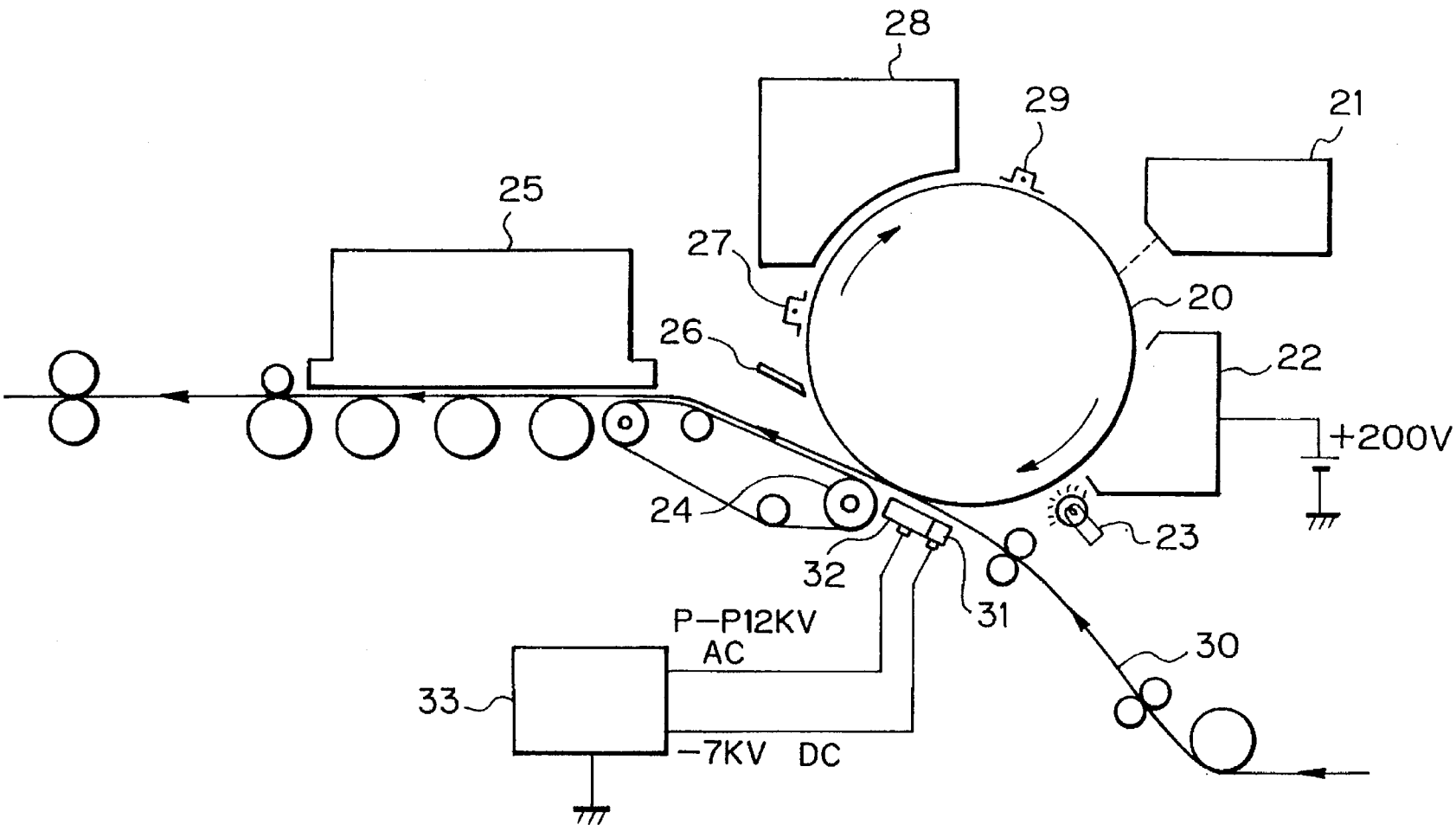
FIG. 2 is an explanatory drawing of the structure of a laser printer printing unit in a preferred embodiment.
Figure 3:
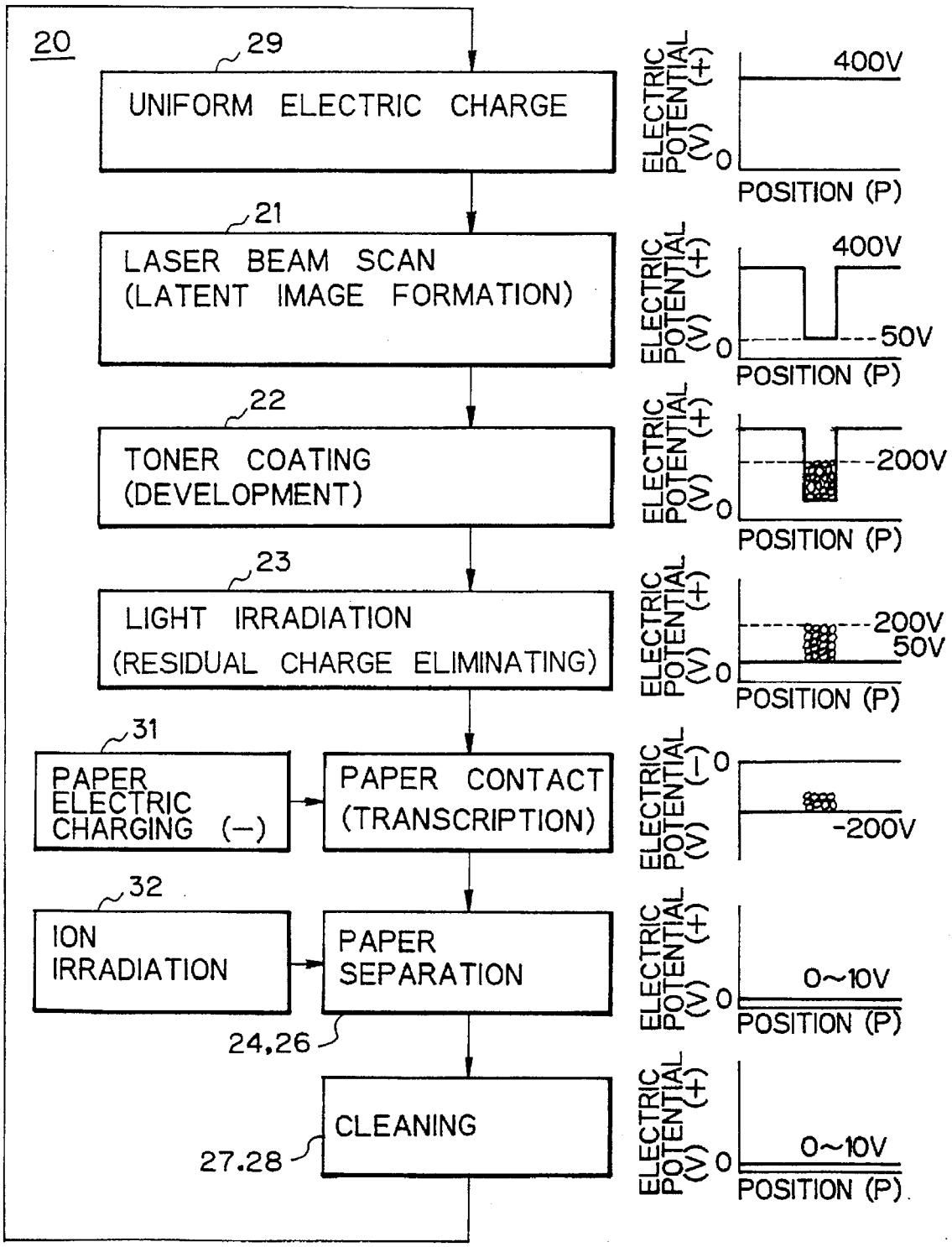
FIG. 3 is a processing flow chart in the printing unit shown in FIG. 2.
Figure 4:
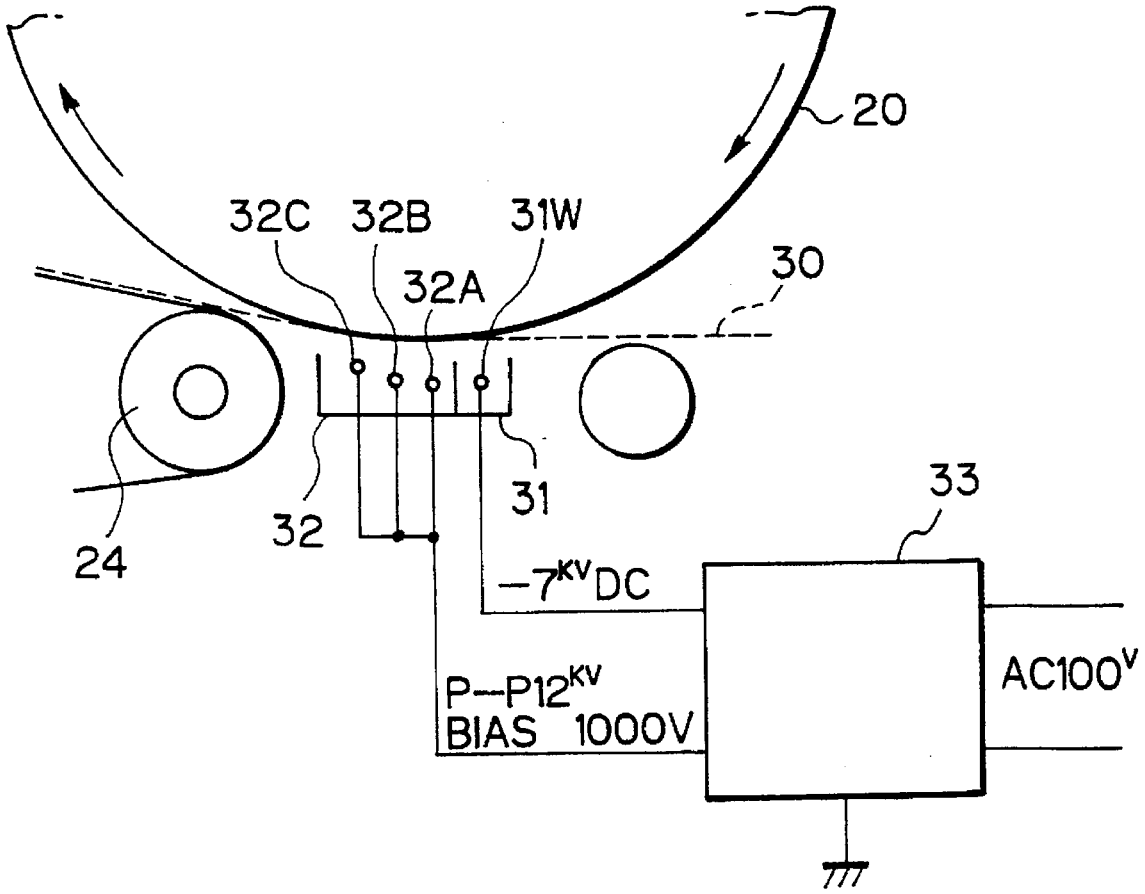
FIG. 4 is a partial expansion view of the printing unit shown in FIG. 2.

Some embodiments will now be described in detail with reference to FIGS. 2 to 4, in which FIG. 2 is an explanatory drawing of the structure of an laser printer in a preferred embodiment, FIG. 3 is a processing flowchart in the laser printer of FIG. 2, and FIG. 4 is a partially expanded view of the laser printer shown in FIG. 2. Here, the paper electricity removal unit is comprised of a corona electric discharge generator using three wires. The distance between the photosensitive body and the wire at the head in the turning direction of photosensitive body is reduced.

In FIG. 2, the photosensitive body 20 is rotatably supported in the laser printer. A uniform electric charger 29, an optical unit 21, residual charge eliminating section 23, a paper charger 31, a paper static electricity removal device 32, a separation roller 24, a scraper 26, a drum static electricity removal device 27, a cleaning unit 28, etc., are arranged around the photosensitive drum 20.

Furthermore, a fixing unit 25 is arranged downstream in a paper passage 30, and the high voltage to be supplied to a paper electric charger 31 and a paper static electricity removal device 32 is generated by a power source unit 33.

At each position on the cylindrical face of photosensitive drum 20 in FIG. 2, a new transfer image is continuously formed during one turn of photosensitive drum 20 and transferred to the paper. On the other hand, the previous transferred image is erased.

That is to say, in the uniform electric charger 29, the cylindrical face of photosensitive drum 20 is uniformly charged with electricity up to the order of 400 V. In the optical unit 21, a continuous laser beam scans the cylindrical face of photosensitive drum 20 to form a latent image whose potential has been locally reduced to about of 50 V.

The developing unit 22 has been biased to 200 V and the high resistance color toner is moved due to the potential on the latent image and selectively adheres to the latent image. In the residual charge eliminating section 23, an intense light is radiated on the cylindrical face of photosensitive body 20 for discharging the static electricity in the background area not covered by the color toner.

The paper electric charger 31 generates a corona electric discharge using a −7 kV direct current voltage from the power source unit 33, transfers negative ions onto the back surface of paper being supplied along the paper passage 30 electrically charges the paper to the order of −200 V. The electrically charged paper comes into contact with, and adheres to, the cylindrical face of photosensitive body 20 to remove the color toner from the cylindrical face of photosensitive body 20.

The paper electric charge removal device 32 generates a corona electric discharge using a 12 kV peak-to-peak alternating current voltage supplied from the power source unit 33, and emits the positive and negative ions onto the back face of paper to offset the electric charge generated by the paper electric charge 31. At this time, the bias voltage of about 1,000 V is given to the paper electric charge removal device 32, the paper is finally charged to about 100 V, becomes the same polarity as that of photosensitive body 20 to cause a repulsive force, and the paper separates from the photosensitive body 20.

A separation roller 24 peels the end of paper off the cylindrical face of photosensitive body 20 and puts it on a transfer belt and guides the paper to a fixing unit 25. In the fixing unit 25, a stroboscope light shines on the surface of paper holding with the color toner, which selectively absorbs the light and fuses with the paper, thus the transferred image is fixed on the paper. In addition, the scraper 26 mechanically peels any paper that could not be separated by the separation roller 24, off the photosensitive body 20.

On the other hand, in the drum electric removal device 27 and the cleaning unit 28, the color toner left over on the cylindrical face of photosensitive body 20 is removed, and a slight electric charge pattern remaining on the surface is also removed, to erase the latent image and the like relating to the previous printing.

Any of the uniform electric charge 29, paper electric charger 31, paper electric charge removal device 32, or drum electric charge removal device 27 may be a corona electric discharge generator of wire type. The corona electric discharge generator is made by tensionning a thin tungsten wire and holding it in an insulated in a box shaped frame body positioned opposite to the cylindrical face of photosensitive body 20. The uniform electric charger 29, paper electric charger 31, paper electric charge removal device 32 and drum electric charge removal device 27 exhibit their respective functions depending on their mounting positions and the kind of voltage being supplied.

In the preferred embodiment shown in FIG. 4, in order to adjust the balance of electric discharge capabilities among three wires 32A, 32B and 32C laid out on the paper electric charge removal device 32, the voltage to be supplied has been made common, while the distance from the three tungsten wires 32A, 32B and 32C to the photosensitive body 20 has been made to differ.

In other words, the wires 32A, 32B and 32C are laid out with the interval of 8 mm among them in the paper feeding direction, the distance to the photosensitive body 20 from the wire 32A and from the intermediate wire 32B positioned at the rear side of the turning direction of photosensitive body 20 is set to 10 mm, whereas the distance to the photosensitive body 20 from the wire 32C positioned at the front side of the turning direction of photosensitive body 20 is set to 8 mm. Additionally, the wires 32A, 32B and 32C are connected mutually to each other at the outside of the frame body, the peak-to-peak 12 kV alternating voltage is biased with a 1,000 V DC voltage.

Thereby, the electric charge removal capability of wire 32C can be enhanced compared to that of wire 32A, the electric charge removal speed of the paper can be reduced through the wires 32A, 32B and 32C, while securing the total electric charge removal capability by the wires 32A, 32B and 32C, and a sudden electric charge removal of paper can be avoided, even if the speed of the paper is raised by turning the photosensitive body 20 quickly.

Figure 5B:
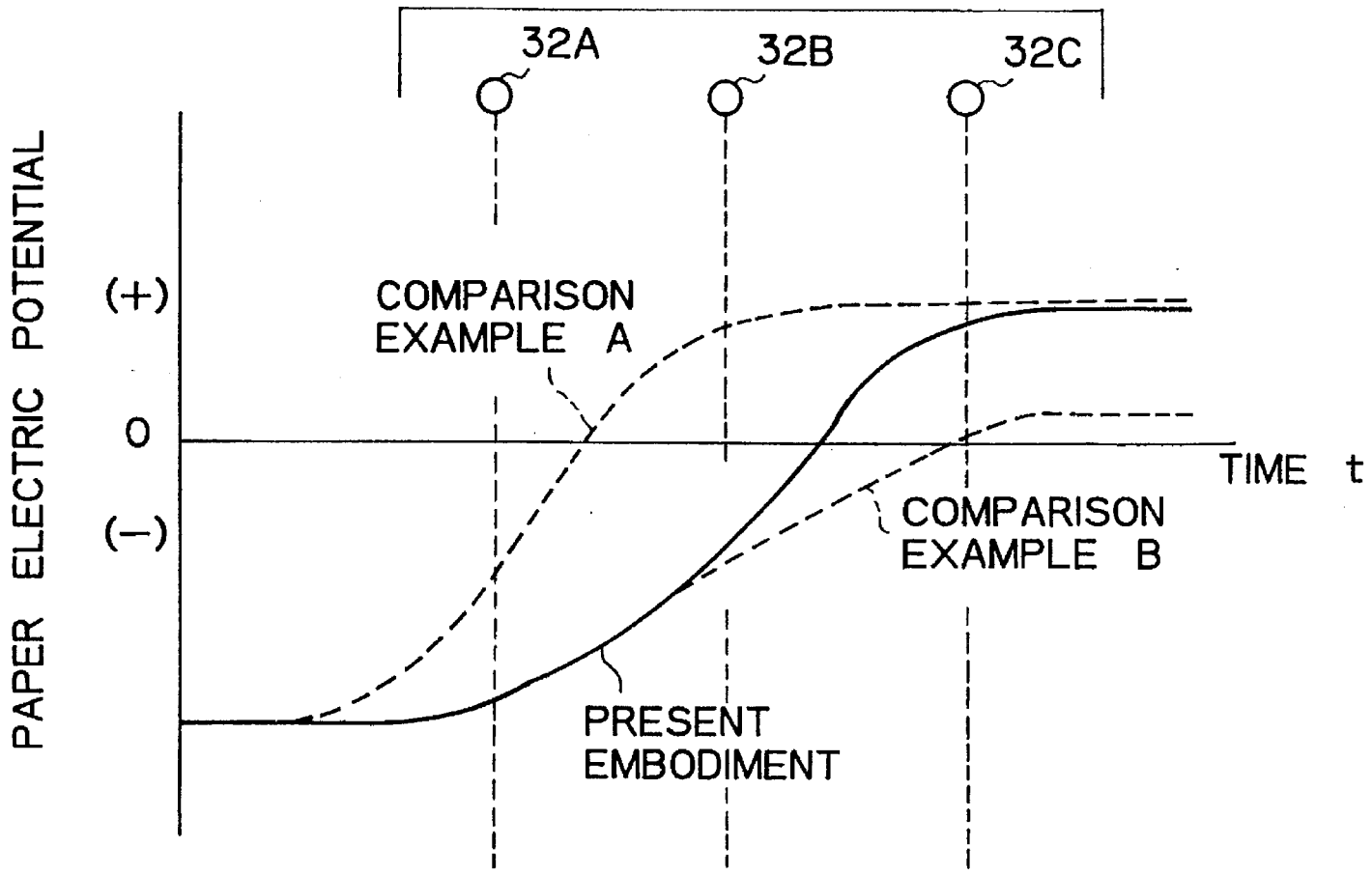
FIG. 5 is an explanatory drawing of the effect available from the present embodiment.

FIG. 5 is an explanatory view of the effect of this preferred embodiment. Item (a) in this figure is the comparison result against two comparison examples, while Item (b) is a conceptual diagram of electric charge removal speed.

In the Comparison Examples A and B in FIG. 5(*a*), the wire 32C in the paper electric charge removal device in the present embodiment has been moved back by 2 mm, and all the three wires 32A, 32B and 32C are arranged at 10 mm apart from the surface of photosensitive body 20. And, in Comparison A, only the bias voltage to be supplied has been raised to 1200 V differing from the voltages of other wires, whereas in Comparison B the alternating current voltage and the bias voltage have been set in common with the present embodiment.

When the printing was conducted at the speed of 120 PPM (Pages Per Minute) using the photosensitive body 20 of 250 mm diameter, good separation of paper and high quality printing coexisted only in the present preferred embodiment. In contrast to this, in Comparison Example A, the print quality dropped and in Comparison Example B, troubles were caused during separation of the paper from the photosensitive body, resulting in frequent paper jams and in misplacement of toner on the paper due to friction.

In the present preferred embodiment in FIG. 5(*b*), the electric charge removal capability of wire 32C near the photosensitive drum can be enhanced, and the entire electric charge removal capability can be secured even after the electric charge removal capabilities of wires 32A and 32B are lowered. For this reason, the potential raising speed of paper in the section between the wires 32A and 32B could be considered equivalent to the potential raising speed in case of Comparison Example A, where if the paper speed was considerably dropped.

Furthermore, because the total electric charge removal capability is low in Comparison Example B, the static electric charge removal from the paper becomes insufficient during high-speed printing. In other words, because the static electric charge removal is gradually intensified toward the paper feeding direction in the present embodiment, the favorable potential relationship between the photosensitive body and the toner is maintained even after increasing the paper speed, and therefore good separation of paper coexists with the high-quality printing during a high speed printing operation.

The reason why the toner does not separate from the paper if the electric charge removal speed of paper has been slowed is deemed attributable to the fact that when the ions are supplied to the back face of paper to remove the static electric charge, the removal of static electric charge of toner is carried out simultaneously and the toner is subjected to the electric charge state repulsive to the cylindrical face of photosensitive body 20. That is to say, it is deemed that, if the speed of static electric removal is too high, the toner cannot fully change its static electric state and therefore when the paper separates from the photosensitive body 20, the toner tends to be attracted to the photosensitive body 20.

Therefore, even in the electric charge removal unit of this embodiment, if the printing speed is further increased, it may become equivalent to reducing the interval between the wires 32A, 32B and 32C shown in FIG. 5(*b*), where the electric charge removal speed equal to Comparison Example A is imposed and then the toner on the paper returns back to the photosensitive body with the possibility for reducing the print quality. At the same time, there is a possibility that only the final static electric charge removal state equal to Comparison Example B can be obtained, thus making it difficult to separate the paper from the photosensitive body.

Therefore, in order to further increase the printing speed, the pass time of electric charge removal unit is extended by increasing the distance between the wires 32A, 32B and 32C. If the increase is difficult in view of the available mounting space, the final electric charge removal state is controlled while maintaining the electric charge removal speed by adjusting the balance of bias voltages among the wires 32A, 32B and 32C. For instance, the wires 32A, 32B and 32C are to be positioned further away from the photosensitive body.

In the above-mentioned embodiments, the distance from the wires 32A, 32B and 32C to the photosensitive body has been adjusted to make the bias voltage common, but, to the contrary, (1) even if the distance from the wires 32A, 32B and 32C to the photosensitive body are made common with the bias voltages being differentiated respectively, of (2) even if both the distance from the wires 32A, 32B and 32C to the photosensitive body and also the bias voltages are differentiated, a similar effect to that of the above-mentioned embodiment can be obtained.

Because, in case of a stout paper, the separation force of paper by its elasticity can be expected, the bias voltage to be applied commonly to the wires 32A, 32B and 32C may be lowered. In addition, because the separation force of paper due to the centrifugal force of photosensitive body can be expected at a high speed printing, it may be acceptable to adopt the adjustment of bias voltages of wires 32A, 32B and 32C.

We claim:

1. A static electricity removal method comprising the following steps of:

forming a transferred image on a photosensitive body;

electrostatically attaching an electrically charged image carrier to said photosensitive body;

supplying ions of reverse polarity of an electric charge of said image carrier to a back surface thereof to offset a charged state of said image carrier so as to easily separate said image carrier from said photosensitive body; and emitting ions from at least a first ion generating means and a second ion generating means biased at the same electrical potential and arranged to radiate ions perpendicularly to an advancing direction of static electricity removal of the image carrier, so that a strength of bias electric field formed between the first ion generating means and said photosensitive body is larger than that of bias electric field formed between the second ion generating means and said photosensitive body wherein the first ion generating means is positioned downstream from the second ion generating means.

2. A static electricity removal apparatus comprising:

at least a first ion generating means and a second ion generating means biased at the same electrical potential and arranged near a photosensitive surface of a photosensitive body for emitting ions onto said photosensitive surface; and a distance between the first ion generating means and said photosensitive surface being shorter than a distance between the second ion generating means and said photosensitive surface wherein the first ion generating means is positioned downstream from the second ion generating means.

3. A static electricity removal apparatus comprising:

at least a first ion generating means and a second ion generating means biased at the same electrical potential and arranged near a photosensitive surface of a photosensitive body for emitting ions onto said photosensitive surface; and a bias voltage exerted to the first ion generating means being higher than that exerted to the second ion generating means wherein the first ion generating means is positioned downstream from the second ion generating means.

4. An electricity removal apparatus comprising:

at least a first wire and a second wire arranged in a direction along a photosensitive surface of a photosensitive body and in parallel to each other for emitting ions onto said photosensitive surface;

frame means for supporting and insulating said wires, so that positions of said at least first and second wires with respect to said photosensitive surface are fixed;

means for supplying high voltage alternating current biased by direct current voltage to said wires, wherein said first and second wires are biased to the same electrical potential, respectively; and a strength of the bias electric field formed between the first wire and said photosensitive body being larger than that of bias electric field formed between the second wire and said photosensitive body when the first wire is positioned downstream from the second wire.

5. An electricity removal apparatus as set forth in claim 4, further comprising:

a third wire in addition to at least the first wire and the second wire, a high voltage negative direct voltage being applied to said second wire;

an image carrier; and said frame means further supporting said third wire integrally with at least the first wire and the second wire, so that said third wire is located at a position upstream from at least the first and the second wire and the position of said third wire is fixed.

6. A static electricity removal apparatus as set forth in claim 4, wherein the first wire is located nearer to said photosensitive surface than the second wire, further comprising:

a high-voltage power supply means for supplying alternating current having a common amplitude to at least the first wire and the second wire; and a bias voltage regulating means for regulating the alternative current supplied by said high voltage power supplying means in accordance with a kind of image carrier, or a surface speed of said photosensitive body.

* * * * *

UNITED STATES PATENT AND TRADEMARK OFFICE

CERTIFICATE OF CORRECTION

PATENT NO.: 5,636,011
DATED : June 3, 1997
INVENTOR(S): FUJIWARA et al.

It is certified that error appears in the above-identified patent and that said Letters Patent is hereby corrected as shown below:

On the title page item [73] the assignee, is incorrect in that the assignee's city is incorrect. Please change "Fujitsu Limited. Takahashi, Japan" to be --Fujitsu Limited. Kawasaki, Japan-- therefor.

Signed and Sealed this

Twenty-third Day of December, 1997

Bruce Lehman

*Attest:*

BRUCE LEHMAN

*Attesting Officer*

*Commissioner of Patents and Trademarks*